US007040038B1

(12) United States Patent
Beaumont

(10) Patent No.: US 7,040,038 B1
(45) Date of Patent: May 9, 2006

(54) APPARATUS FOR PROCESSING PERMEABLE OR SEMI-PERMEABLE WEBS

(75) Inventor: Donald F. Beaumont, Cape Elizabeth, ME (US)

(73) Assignee: Metso Paper USA, Inc., Biddeford, ME (US)

( * ) Notice: Subject to any disclaimer, the term of this patent is extended or adjusted under 35 U.S.C. 154(b) by 0 days.

(21) Appl. No.: 09/146,226

(22) Filed: Sep. 2, 1998

(51) Int. Cl.
*D06F 58/00* (2006.01)

(52) U.S. Cl. ..... 34/114; 34/124; 162/204; 162/358

(58) Field of Classification Search ..... 34/108, 34/109, 110, 111, 114, 115, 199, 122, 123, 34/124, 112, 116, 117, 120; 162/204, 358
See application file for complete search history.

(56) References Cited

U.S. PATENT DOCUMENTS 4,297,794 A * 11/1981 Luthi ..... 34/122
4,523,390 A * 6/1985 McCarthy ..... 34/115
4,542,596 A * 9/1985 Bryand et al. ..... 34/115
4,556,450 A * 12/1985 Chuang et al. ..... 162/204
5,020,242 A * 6/1991 Mayer ..... 34/115
5,546,675 A * 8/1996 McGraw ..... 34/113
5,575,084 A * 11/1996 Vuorinen ..... 34/460
5,775,002 A * 7/1998 Iwase et al. ..... 34/122
5,974,684 A * 11/1999 Steiner ..... 34/115
6,044,575 A * 4/2000 Marschke ..... 34/124
6,585,139 B1 * 7/2003 Holtmann ..... 226/95

* cited by examiner

*Primary Examiner*—S. Gravini
(74) *Attorney, Agent, or Firm*—Pierce Atwood LLP; Kevin M. Farrell

(57) ABSTRACT

An air processing cylinder useful in drying, curing, thermal bonding, cooling, and web transferring materials such as fabrics, papers, and the like. Air is exhausted out of the cylinder surface through a plurality of conduits equipped with distribution means for profiling the flow of air. The drying cylinder further includes a duct network on its outer shell for exhausting air out of one axial area only or, alternatively, the drying cylinder may contain multiple duct networks for exhausting air out of several axial areas, each having its own flow characteristics.

6 Claims, 6 Drawing Sheets

61
56
53
55
26
36
12
14
18
19
34
36
46
44
38

APPARATUS FOR PROCESSING PERMEABLE OR SEMI-PERMEABLE WEBS

BACKGROUND OF THE INVENTION

This invention relates to an air processing apparatus for drying, curing, thermal bonding, cooling, and web transferring permeable or semi-permeable webs such as fabrics, paper, or the like.

Typical of such an apparatus is the honeycomb system described in U.S. Pat. No. 4,542,596. In this system, a non-rotating structure within the roll provides multiple zones for web processing and a vacuum is applied to a plurality of honeycomb grilled conduits so that the web can be dried uniformly and without the 'blind spots' which characterize other devices. Unfortunately however, this patented system is flow limited due to the vacuum source and, also, it is limited because air flow through the conduits is not distributed evenly. Moreover, the incorporation of multiple vacuum means within the roll so as to create different zones of air flow on the drying cylinder is difficult to achieve because of the limited space within the cylinder.

The present invention is an improvement over this and other known devices because it allows multiple zones to be created within a cylinder without an internal non-rotating structure; moreover, it allows air to flow equally through the inlet and outlet holes of the conduits so that a web can be dried evenly.

As a result, the present invention makes it possible to isolate and direct air flow into a greater number of separate zones on a single cylinder so that the process air of one zone cannot mix with the process air of another zone.

This ability to selectively isolate and direct air flow into a multiplicity of zones is a feature not shared by the apparatus covered in U.S. Pat. No. 4,542,596 so that now, for the first time, it is possible to obtain economies in energy and other advantages such as isolating contaminants which, heretofore, were impossible to achieve.

These advantages are obtained by incorporating within each cylinder a stationary air distribution tube which distributes process air uniformly throughout the cylinder in an axial direction.

This distribution tube is fixed within the cylinder but it is distinguishable from the non-rotating structure of U.S. Pat. No. 4,542,596 because it revolves as the cylinder revolves and, therefore, is not stationary.

The air which is impelled by the distribution tube within the cylinder ultimately escapes through the outer porous shell through a multiplicity of air zones, a feature which distinguishes this invention from those devices which exhaust the process air from the drying roll in an axial manner.

SUMMARY OF THE INVENTION

It is an object of this invention to provide a novel roll for the through-air processing of permeable and semi-permeable webs. Typical applications include, for example, drying, cooling, and thermal bonding paper, fabrics, webs, and other sheet-like material.

Another object is to provide a novel cylinder which because of its high open area lends itself to the tensioning of impermeable products.

The roll of this invention provides for exhausting air out of one axial area only, or it may contain several axial areas, each having various air flow characteristics, and each of which may be exhausted simultaneously or preferentially, depending on the material which is to be treated.

Air is exhausted from the roll through the outer surface of the shell, a feature which makes it possible to enhance and control air flow by varying the shell length, something that is not possible with rolls that exhaust air through their axial ends only.

In the present invention, the object is to use the surface of the cylinder for both air supply and air exhaust.

By comparison, known devices, specifically those which exhaust air from a cylinder's axial ends in high flow applications, reach air velocities that are so high as to make energy consumption excessive.

The present invention overcomes this drawback in energy consumption and achieves significant economies by neither limiting nor directing the air exhaust exclusively to the cylinder's roll ends. Instead, the exhaust air is impelled and directed through the shell of the cylinder, and the exhaust area can be expanded for any roll size merely by extending the width of the roll so as to keep exhaust velocities low and minimize energy consumption.

Since air is forced out of the cylinder surface, the area available for exhausting air is virtually unlimited and it can be increased by merely increasing the length of the cylinder. This exhaustability has significant process advantages over devices which employ cylinders whose exhaust area is confined to the cylinders axial ends.

Accordingly, the structure of the present roll makes it useful in high-flow applications because the exhaust air flow area can be increased by simply extending the outside length of the shell to any desired degree.

Structurally, the roll of this invention consists of an outer shell and, beneath the shell exterior, one or more channels equipped with distribution means for profiling the flow of air. The ends of the roll are capped.

The shell may be comprised of any porous material. For example, when high-flow applications are needed, highly porous shells having a high open area in excess of 50% are desirable.

Typical shells include, for example, honeycomb type shells or square grids fabricated from thin material as, for example, material measuring 0.2 to 4 mm in thickness. When a high-open-area type shell construction is used, the shell is covered with a wire screen that bridges the grid and supports the product which is to be dried.

Within each roll, beneath the outer surface of the shell, axial dividers extend radially and intersect an inner cylinder to form channels. And within each channel there is contained a perforated plate that serves as a distribution means for profiling the flow of air. Although the normal object of this plate is to uniformly distribute air flow in the axial direction, it can also be used to vary the flow profiles.

These channels limit the air flow to the radial and axial directions only and, thus, make it possible to divide the roll into numerous circumferential zones which may be processed independently.

Thus, for example, the roll can be divided into a high flow zone for web transfer onto the roll followed by a zone where hot air is supplied for drying and, also, a zone where there is no air flow so that the product can be easily transferred off the roll.

This ability to divide the roll both circumferentially and axially makes it possible to achieve a checkerboard of processing zones so that several operations can be independently achieved on the same roll.

DETAILED DESCRIPTION OF THE PREFERRED EMBODIMENTS

Figure 1:
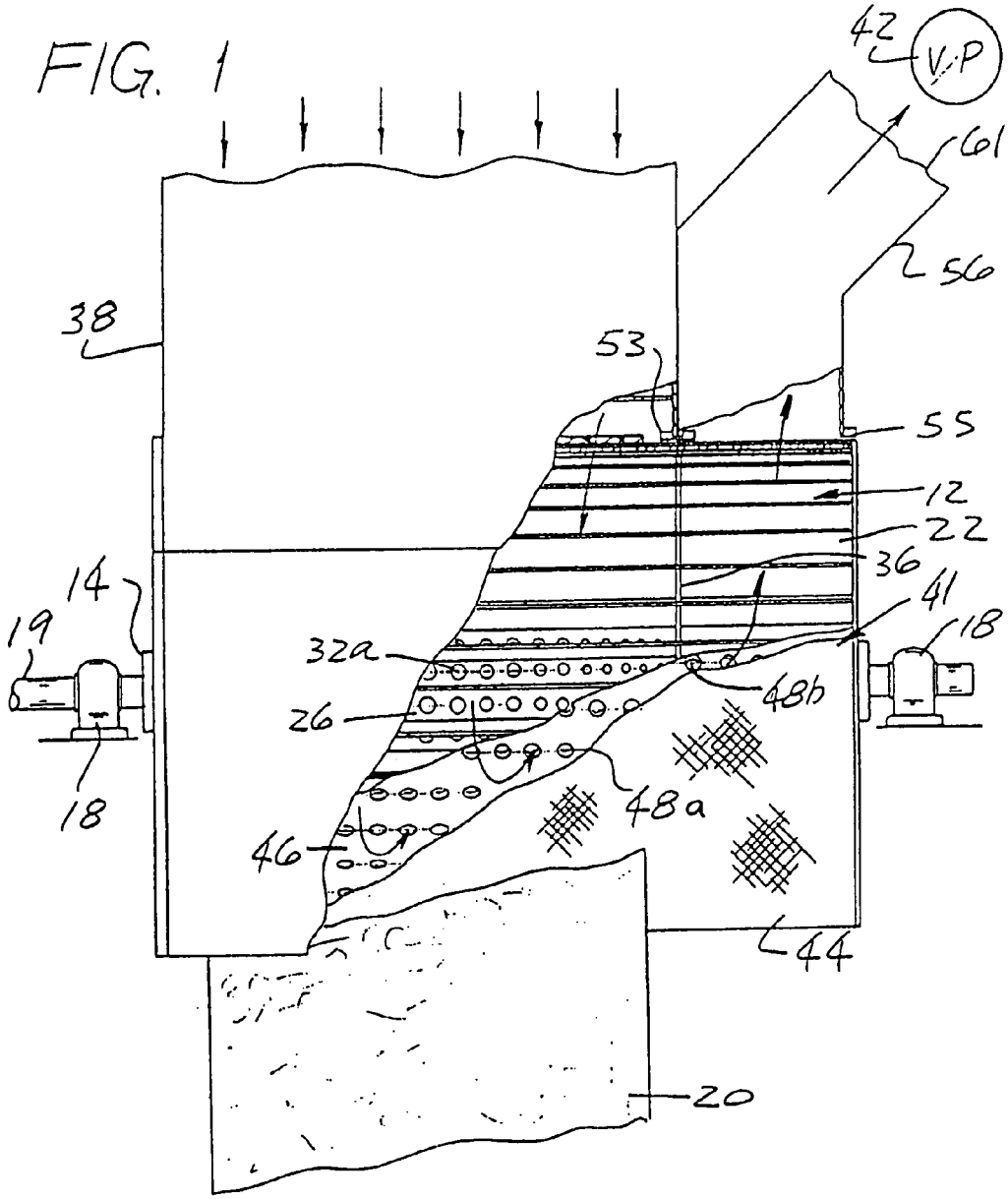
FIG. 1 is an elevational view with portions cut away to illustrate the elements of the drying cylinder.

The use of this apparatus in drying permeable and semi-permeable webs is best illustrated by FIG. 1 which shows a web 20 being fed onto the drying cylinder of this invention by conventional guideroll means (not shown).

The drying cylinder 12 (FIGS. 1 and 2) consists essentially of a cylindrical hub 14 mounted on an axle 19 which is rotatably mounted in a pair of bearings 18. The cylinder 12 includes a plurality of axially extending conduits 22 arranged together in cylindrical configuration. These conduits 22 are formed by a plurality of radial plates 24 (FIG. 2) extending along the longitudinal axis of the drying cylinder 12. Plates 24 extend outward radially from hub 14 to the periphery of cylinder 12. Each of the conduits 22 has their radial plates 24 converging toward each other so as to form a generally inwardly tapered channel 15 where they intersect the cylindrical hub 14 (FIG. 3).

The conduits 22 are covered by a cylindrical shell 41 (FIG. 3) comprised of a screen 44 and a cylindrical underframe or support structure 46. This support structure 46 may be in the form of a perforated plate equipped with a reticulated pattern of holes which are shown as inlet ports 48*a* and outlet ports 48*b* in FIGS. 1 and 4 or it may take the form of a honeycomb-type shell or grid-type structure. In either case, the support structure 46 and radial plates 24 are fabricated from steel or other suitably rigid material and the screen 44 is steel wire mesh or an interwoven fabric.

Figure 4:
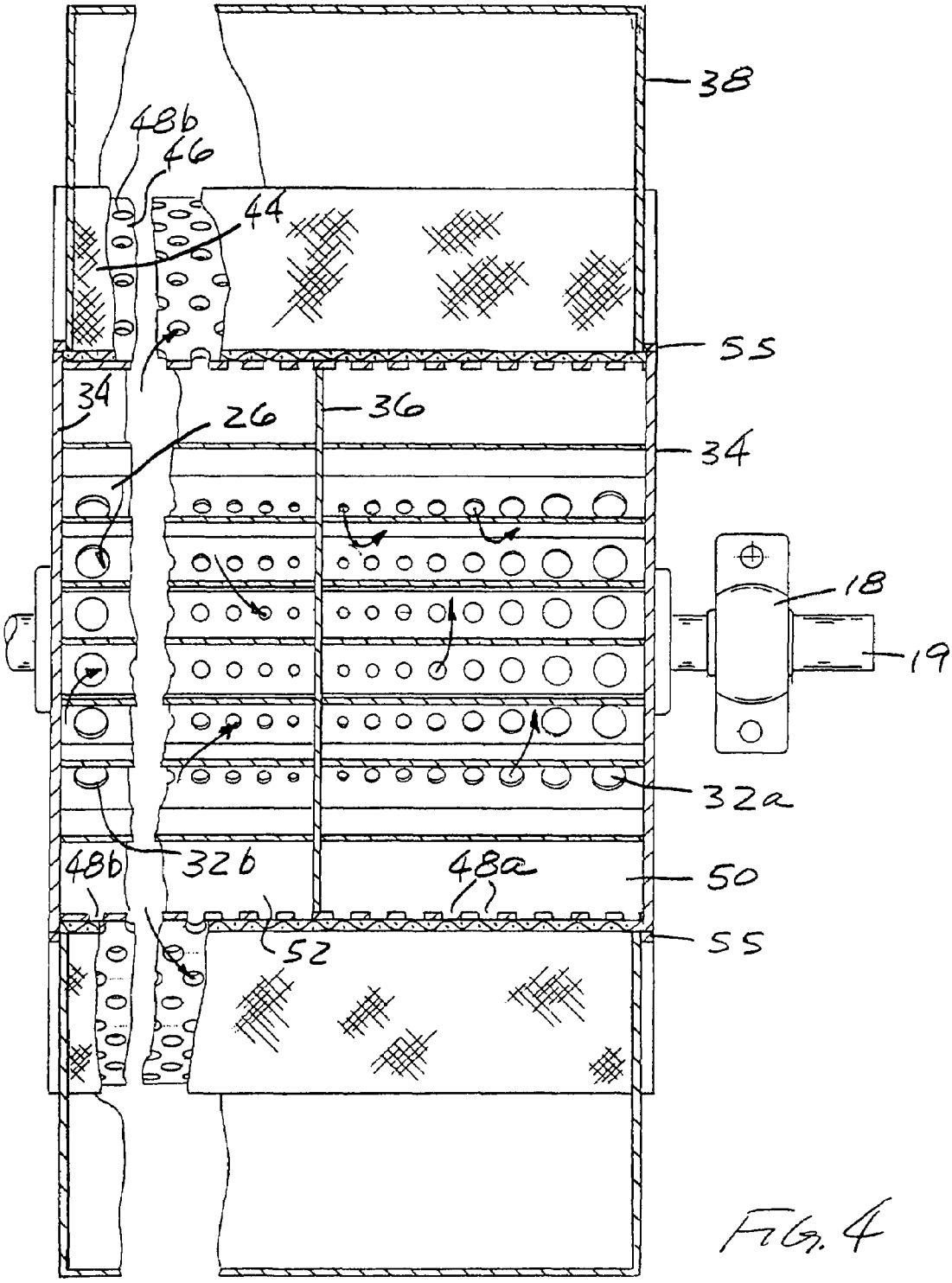
FIG. 4 is a sectional view taken along line 4—4 of FIG. 2 with portions cut-away.
Figure 5:
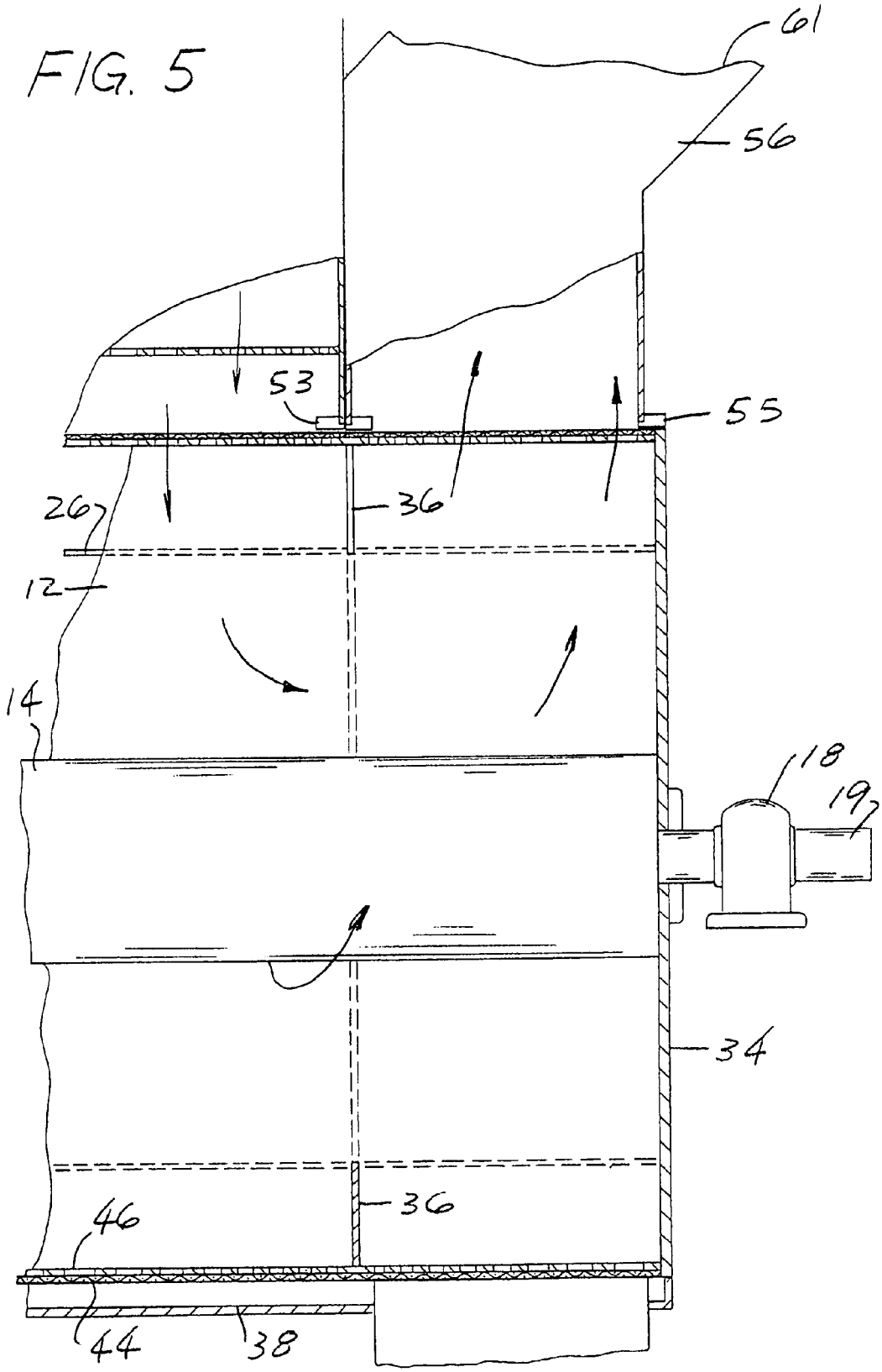
FIG. 5 is a sectional view taken along line 5—5 of FIG. 2.

The support structure 46 generally has an open surface area which is capable of accommodating a wide range of applications. Typical of these are operations in which the open areas are in excess of 50%, in which case the inlet ports 48*a* and outlet ports 48*b* cover a combined area of more than one-half the total surface; however, this process is not limited to rolls with large open areas only, and it is to be understood that smaller open areas as, for example, those of less than 50%, are also within the scope of this invention. If the support structure 46 is a perforated plate, its radial thickness may be in the range of from about 0.2 to 4 mm; however, if a honeycomb or grid-type structure is employed then their respective radial thicknesses will be appreciably greater and may be in the range of from about 25–200 mm. The support structure 46 is covered by a screen 44 that supports the web 20. The axially extending conduits 22 are sealed at their ends by circular end portions 34 as shown in FIGS. 4 and 5 or each respective end may be sealed individually.

A vertically disposed divider air dam 36, which is parallel to the end portions 34, extends partially through the drying cylinder 12 and divides each conduit 22 longitudinally into a front chamber 50 having inlet ports 48*a* and a rear chamber 52 having outlet ports 48*b*. The air dam 36 extends circumferentially around the drying cylinder 12 as shown in FIG. 5.

Figure 2:
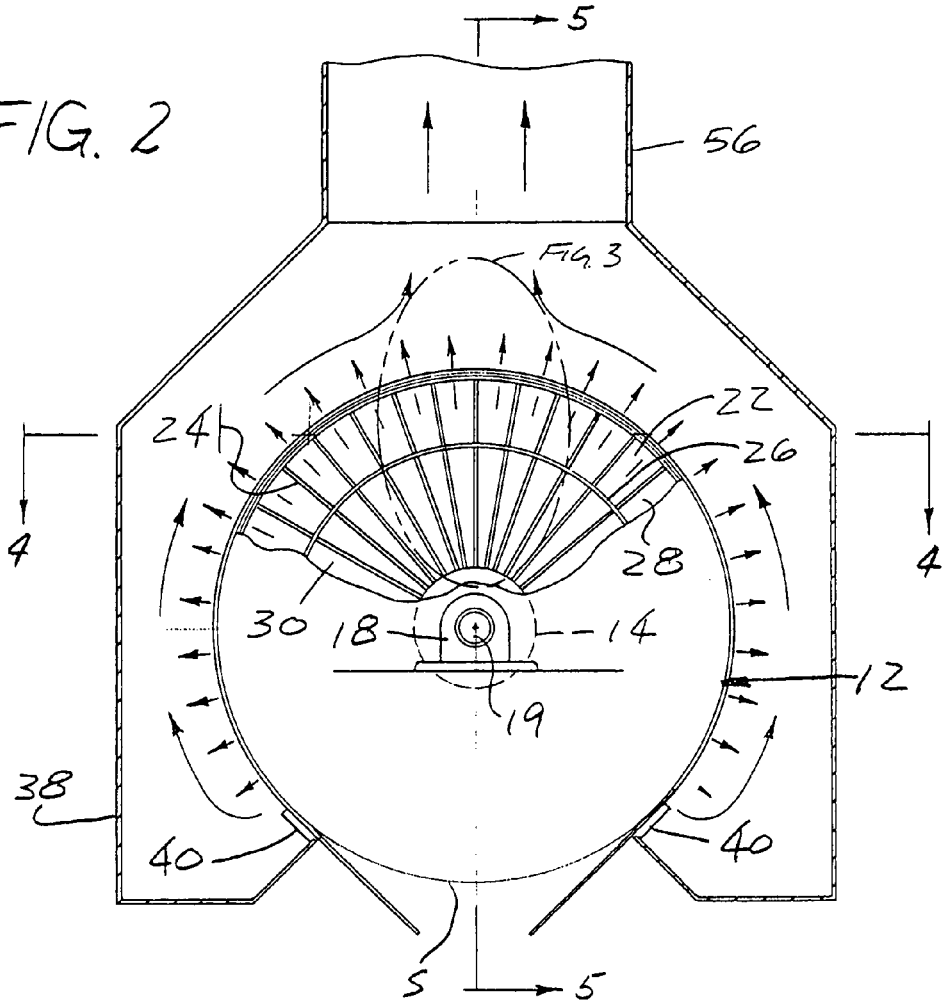
FIG. 2 is an elevational view of the drying cylinder for use in the air processing of a paper web or the like made up of a plurality of axially extended grilled segments.
Figure 3:
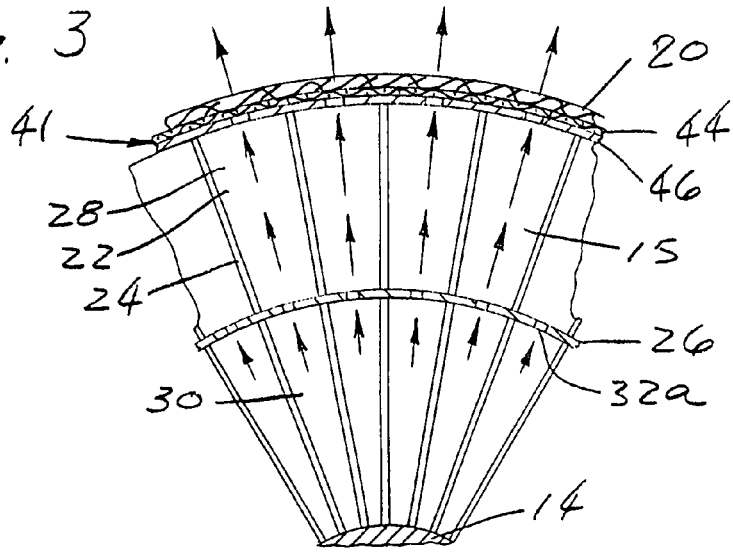
FIG. 3 is an enlarged fragmentary elevational view of that section of the drying cylinder which is contained within the phantom lines shown in FIG. 2.

An inner cylindrical axial air distributor 26, constructed and arranged to be concentric with the longitudinal axis of the cylindrical hub 14, divides each of the conduits radially into an outer chamber 28 and inner chamber 30 (FIGS. 2 and 3). The inner cylindrical axial air distributor 26 is perforated with flow port means in the form of apertures 32*a* and 32*b* (FIG. 4) which provide for air flow between said inner chamber 30 and outer chamber 28. As seen in FIGS. 1 and 4, the apertures become progressively smaller as they near the air dam 36 and larger as they approach the end portions 34. This has the effect of evenly distributing air flow; however, other means of evenly distributing air flow as, for example, by the use of a longitudinally extended graduated slot may also be employed. Moreover, it should be noted that the apertures in the air distributor may be sized to any desired dimension so as to achieve any desired air flow profile or, alternatively, the position of the radial plates 24 may be varied to obtain the desired flow profile.

The exterior of drying cylinder 12 is partially enclosed by a housing 38. A pair of axial seals 40 extend along the longitudinal axis of the cylindrical hub 14 and seal the drying cylinder 12 against the housing 38 as shown in FIG. 2. The seals 40 extend axially across the width of the conduits 22 so as to eliminate any gap between the seal and the radial plate and thus avoid or minimize air leakage. Thus, the web 20 can be removed at the sector S where the web 20 is not enclosed by the housing 38 since there is no air flow in that zone.

The housing 38 includes a front intake duct 54 (FIG. 6), arranged to supply air to the inlet ports 48*a*, and a rear exhaust duct 56. A circumferential air seal 53 (FIGS. 1 and 5) is positioned between the intake and exhaust ducts to prevent air leakage therebetween. In embodiments where a plurality of intake and/or exhaust ducts are used (discussed below), it should be understood that seals would be disposed between these intake/exhaust ducts as well. A second circumferential air seal 55 (FIG. 4) is secured to the outboard edge of the housing 38 to prevent leakage of air from housing 38. Still another seal 55 is fitted onto the outboard edge of the exhaust duct 56 to avoid having outside air leak into the system.

The air flow illustrated by the arrows in FIGS. 1, 2, 3, 6, and 7 is produced by a vacuum source (42, 42*a*, and 42*b*) located at the exhaust opening 61 (FIGS. 1 and 6), which draws air into the inlet ports 48*a* and through the apertures 32*a* of the air distributor 26. The air then flows longitudinally through the conduits 22 under the air dam 36 to the rear chamber 52 (FIG. 4). The air is then drawn through the apertures 32*a* of the air distributor 26 and expelled through the outlet ports 48*b* to the exhaust duct 56; however, it should be noted that other means for channeling air through the conduit as, for example, by the use of blower means may also be employed.

Figure 6:
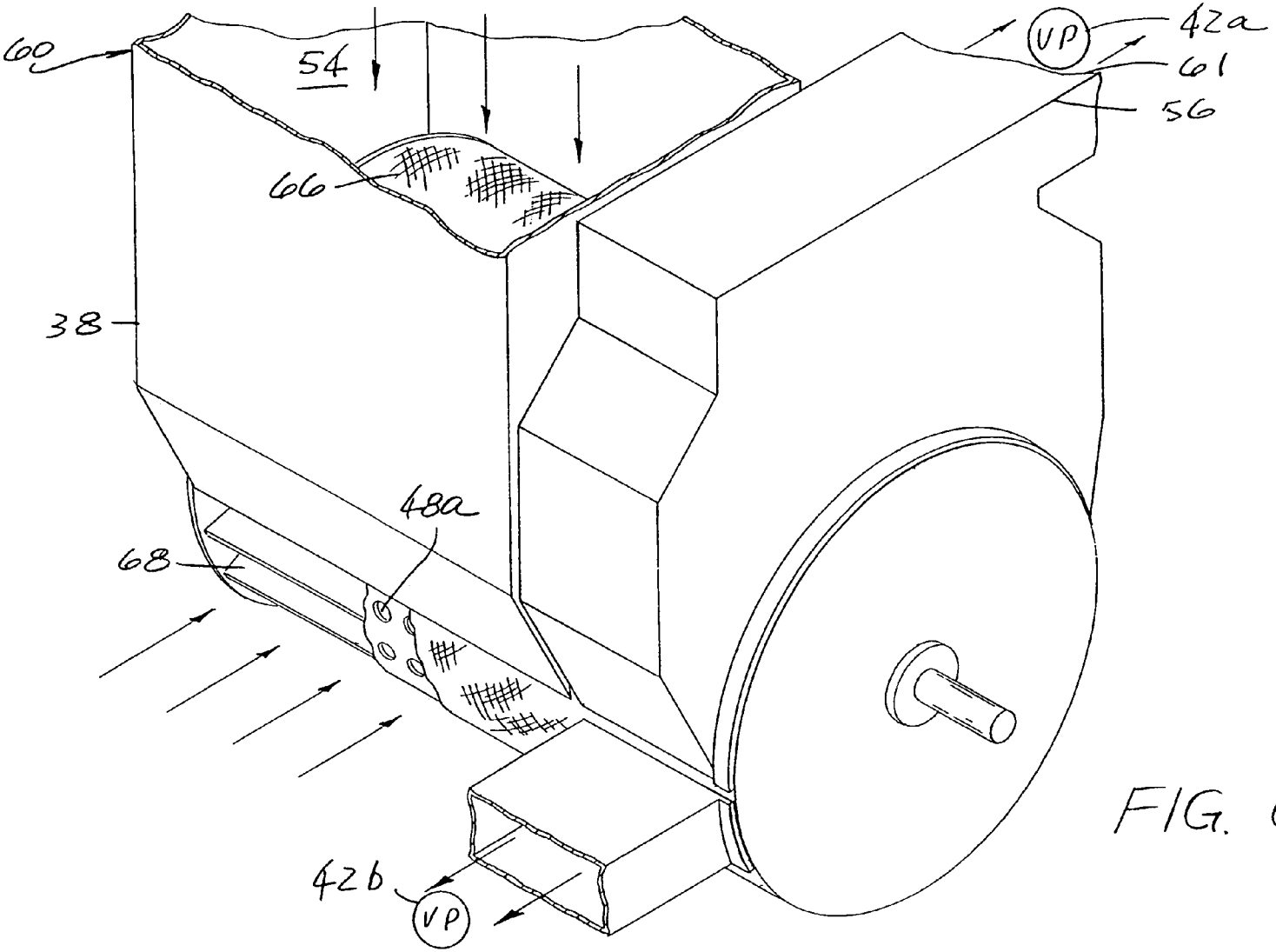
FIG. 6 is a perspective view of another embodiment of the drying cylinder which is shown within a housing equipped with an air intake duct and showing sections cut away to illustrate air flow.
Figure 7:
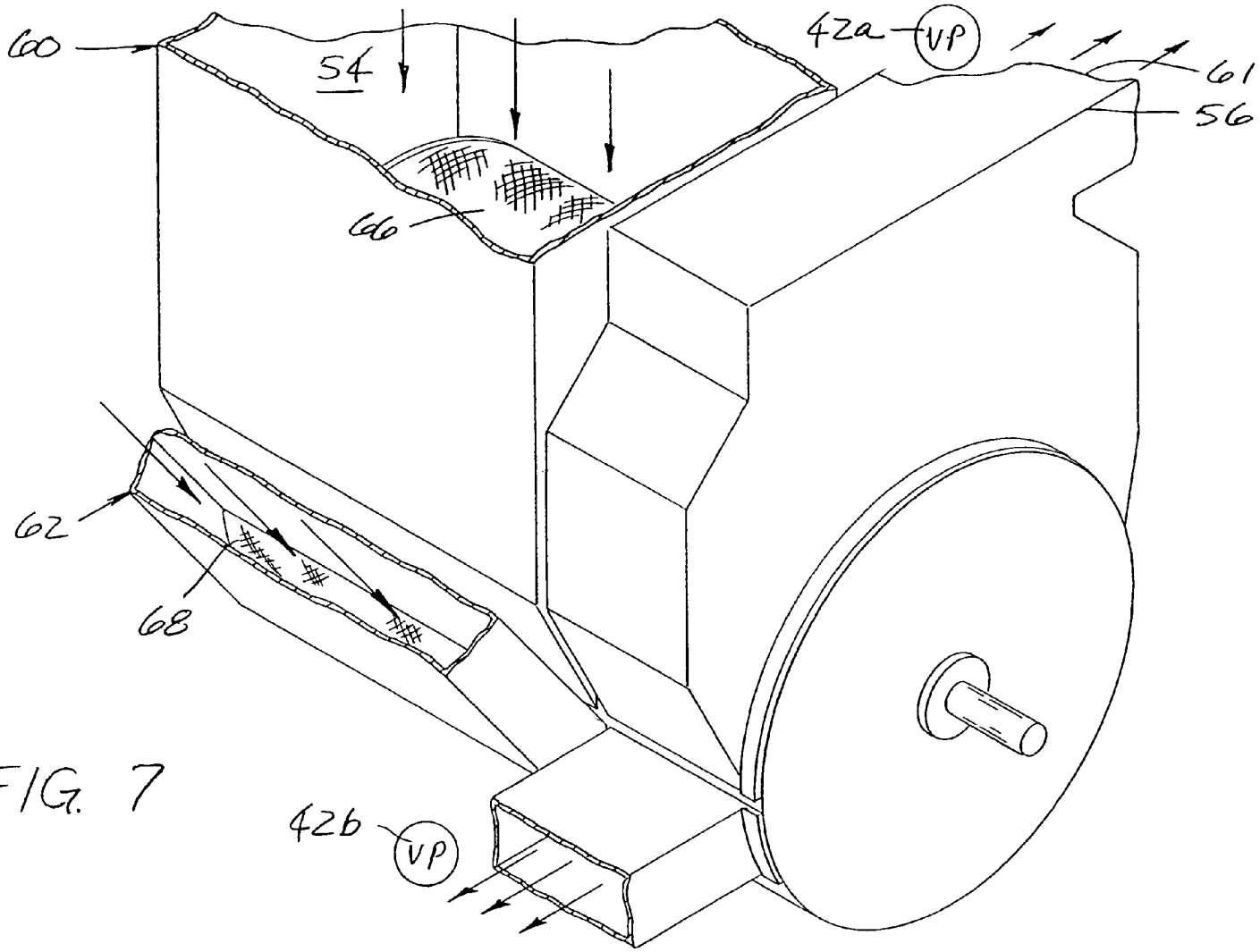
FIG. 7 is a perspective view of an alternative design showing a drying cylinder equipped with a second air intake duct, also with portions cut away to illustrate air flow.

According to another embodiment as shown in FIG. 7, the drying cylinder includes two areas or zones of desired air flow. In this embodiment, an upper intake and exhaust duct network 60 combines with vacuum source 42*a* to form a first zone 66 and a lower intake and exhaust duct network 62 combines with vacuum source 42*b* to form a second zone 68. If desired, the lower intake duct can be removed as shown in FIG. 6, or multiple intake and exhaust duct networks for multiple zones can be employed.

Because air is exhausted out of the outer diameter of the shell, this system is not flow limited and, in fact, air flow can be enhanced and controlled by extending the width of the shell. This is a significant advantage over rolls that exhaust air out the axial ends only.

In summary, this drying cylinder is comprised of plates that penetrate radially into the cylinder and form conduits which intersect an inner cylindrical hub 14. The conduits are further divided axially to create within the cylinder multiple zones which produce various air flow characteristics on the outer surface of the drying cylinder. Further, the inlet and outlet holes of the air distributor 26 are sized to permit the air to flow evenly or create a desired profile. Although a honeycomb type shell may be used, it is not essential and other types of shells may also be employed.

While the preferred embodiments have been fully described and depicted for the purposes of explaining the principles of the present invention, it will be appreciated by those skilled in the art that modifications and changes may be made thereto without departing from the spirit and scope of the invention set forth in the appended claims.

What is claimed is:

1. A rotating, radially-ventilated cylinder roll for the through-air-processing of permeable and semi-permeable webs, the cylinder roll comprising:

a plurality of plates extending radially from rotatable hub and connected to end portions disposed at the ends of the hub, the hub defining a longitudinal axis about which the hub and the plurality of plates are rotatable, the plurality of radial plates defining a plurality of conduits extending along the length of the roll;

an air distributor disposed concentrically about the hub and coaxial with the longitudinal axis, the air distributor dividing the plurality of conduits into an outer chamber and an inner chamber, the air distributor further defining a plurality of apertures through which air may pass;

a support structure disposed concentrically about the hub and coaxially with the longitudinal axis, the support structure attached to and enclosing the plurality of radial plates;

an air dam disposed radially about the hub, the air dam connected to the air distributor, the support structure, and the plurality of plates, the air dam dividing the outer chamber into a front chamber and a rear chamber;

wherein air drawn through the cylinder roll for the through-air-processing of permeable and semi-permeable webs enters radially through the front chamber of the cylinder roll and exits radially through the rear chamber of the cylinder roll.

2. The cylinder roll of claim 1 further comprising a screen disposed about the support structure.

3. The cylinder roll of claim 1 wherein the support structure defines a plurality of ports thereon.

4. The cylinder roll of claim 1 wherein the plurality of apertures within the air distributor are variable in size.

5. The cylinder roll of claim 4 wherein the plurality of apertures are smaller in size near the air dam and larger in size near the ends of the roll.

6. The cylinder roll of claim 1 wherein the conduits are variable in size.

* * * * *